US006390200B1

(12) United States Patent
Allamon et al.

(10) Patent No.: US 6,390,200 B1
(45) Date of Patent: May 21, 2002

(54) DROP BALL SUB AND SYSTEM OF USE

(75) Inventors: Jerry P. Allamon, Montgomery; Kenneth David Waggener, Houston, both of TX (US)

(73) Assignee: Allamon Interest, Montgomery, TX (US)

( * ) Notice: Subject to any disclaimer, the term of this patent is extended or adjusted under 35 U.S.C. 154(b) by 0 days.

(21) Appl. No.: 09/527,784

(22) Filed: Mar. 17, 2000

Related U.S. Application Data

(60) Provisional application No. 60/180,247, filed on Feb. 4, 2000.

(51) Int. Cl.[7] ..... E21B 23/08; E21B 23/12

(52) U.S. Cl. ..... 166/376; 166/153; 166/177.4; 166/317; 166/318; 166/386

(58) Field of Search ..... 166/153, 155, 166/177.4, 317, 318, 327, 376, 381, 386, 290

(56) References Cited

U.S. PATENT DOCUMENTS

| | | | | | |
|---|---|---|---|---|---|
| 2,460,561 | A | * | 2/1949 | Winkelmann | 166/155 X |
| 2,737,244 | A | * | 3/1956 | Baker et al. | 166/318 X |
| 3,051,244 | A | * | 8/1962 | Litchfield | 166/318 X |
| 4,064,937 | A | | 12/1977 | Barrington | 166/162 |
| 4,566,541 | A | * | 1/1986 | Moussy et al. | 166/318 |
| 4,566,544 | A | * | 1/1986 | Bagley et al. | 166/318 X |
| 4,580,632 | A | | 4/1986 | Reardon | 166/250 |
| 4,658,902 | A | * | 4/1987 | Wesson et al. | 166/317 |
| 4,934,452 | A | | 6/1990 | Bradley | 166/153 |
| 5,018,579 | A | | 5/1991 | Braddick et al. | 166/291 |
| 5,413,172 | A | | 5/1995 | Laurel | 166/153 |
| 5,775,421 | A | * | 7/1998 | Duhon et al. | 166/317 X |
| 5,960,881 | A | | 10/1999 | Allamon et al. | 166/291 |
| 6,053,250 | A | * | 4/2000 | Echols | 166/317 |
| 6,082,451 | A | | 7/2000 | Giroux et al. | 166/72 |
| 6,220,360 | B1 | | 4/2001 | Connell et al. | 166/373 |

* cited by examiner

*Primary Examiner*—George Suchfield
(74) *Attorney, Agent, or Firm*—McGlinchey Stafford; Clarence Eriksen

(57) ABSTRACT

The present invention provides a drop ball sub that may be used to drop a large ball having an outer diameter larger than the inner diameter of a restriction in the wellbore such as the running tool used to run a first casing string through a second casing string. A smaller ball is used to control dropping of the large ball. The smaller ball has an outer diameter smaller than the restriction. The drop ball sub of the present invention may be used to operate any downhole tool that would benefit by receipt of a large ball. By dropping a larger ball, in one use of the invention larger valves can be controlled in the float equipment that provide a larger fluid flow path. A larger fluid flow path reduces surge pressure and enables the system to handle more debris. The present invention provides a system that preferably provides for a diverter tool above the running tool and a diverter tool below the running tool. The use of the upper diverter in conjunction with the lower diverter tool permits fluid flow into the second casing string to reduce back pressure and provide a large volume flow path.

10 Claims, 7 Drawing Sheets

DROP BALL SUB AND SYSTEM OF USE

CROSS-REFERENCE TO RELATED APPLICATION

This application claims the benefit of the filing date of U.S. Provisional Application, Ser. No. 60/180,247, filed Feb. 4, 2000.

FIELD OF THE INVENTION

The present invention relates to a downhole drop ball sub for use in a wellbore. The present invention is highly suitable for use in a downhole surge pressure reduction system or for other purposes. More particularly the present invention relates to a drop ball sub that may be used in conjunction with a running tool or other wellbore tools to allow launching a ball in the wellbore whose diameter is larger than the internal diameter of the running tool, drill string, tubing string, or any other restrictions found in the wellbore. The embodiment of the system for surge pressure reduction also includes a unique enlarged flow path that permits increased flow to reduce surge pressure and better handle debris.

DESCRIPTION OF THE RELATED ART

One problem frequently encountered in many wellbore operations is the need to overcome the limitation of a restriction in the wellbore that prevents use of a ball below that restriction where the ball has a diameter greater than the restriction. More particularly, one of skill in the art will realize that it has heretofore been impossible to use a ball downhole that has a diameter which is greater than the diameter of the restriction in the wellbore. The term "ball" also includes any other suitable object, e.g. bars, darts, plugs, and the like. Typically a ball is used downhole to activate, seal, or otherwise perform a useful function.

One embodiment or use of the present invention is effective for reducing surge pressure. For a long time prior to the previous invention for reducing surge pressure as taught in U.S. Pat. No. 5,960,881, which is incorporated herein by reference, the oil industry had been aware of the problem created when lowering a first casing string, which may be a casing liner, at a relatively rapid speed in drilling fluid. This rapid lowering of the casing liner results in a corresponding increase or surge in the pressure generated by the drilling fluid due to the relatively small annulus between the casing liner and the surface casing. The formation about the borehole into which the casing liner is lowered is exposed to the surge pressure.

This surge pressure has been problematic to the oil industry in that it has many detrimental effects. Some of these detrimental effects are 1.) loss volume of drilling fluid, which presently costs $40 to $400 a barrel depending on its mixture, that is primarily lost into the earth formation about the borehole, 2.) resultant weakening and/or fracturing of the formation when this surge pressure in the borehole exceeds the formation fracture pressure, particularly in older formations and/or permeable (e.g. sand) formations, 3.) loss of cement to the formation during the cementing of the casing liner in the borehole due to the weakened and, possibly, fractured formations resulting from the surge pressure of the formation, and 4.) differential sticking of the drill string or casing liner being run into a formation during oil operations, that is, when the surge pressure in the borehole is higher than the formation fracture pressure, the loss of drilling fluid to the formation allows the drill string or casing liner to be pushed against the permeable formation downhole and allows it to become stuck to the permeable formation.

This surge pressure problem had been further exacerbated when running tight clearance casing liners or other apparatus in the existing casing. For example, the clearances in recent casing liner runs have been about ½" to ¼" in the annulus between the casing liner and existing casing. This small annulus area in these tight clearance casing liner runs have resulted in corresponding higher surge pressures and heightened concerns over their resulting detrimental effects of surge pressure. The most common known response to surge pressures was to decrease the running speed of the drill string supporting the casing liner downhole to maintain the surge pressure at an acceptable level. An acceptable level would be a level at least where the drilling fluid pressure, including the surge pressure, is less than the formation fracture pressure to minimize the above detrimental effects. Any reduction of surge pressure would be beneficial because the more surge pressure is reduced, the faster the drill string or casing liner could be run. Time is money, and the system of U.S. Pat. No. 5,960,881 significantly reduces the number of hours required for running the casing string downhole while still avoiding the detrimental effects discussed above.

However, it would be desirable to provide an even larger flow path to further reduce surge pressure, to allow better debris removal, and to reduce the possibility of plugging the float equipment. In the prior art, running tools have an internal diameter that is limited or restricted to about 3 inches to 3.4 inches. It would be desirable to use a ball in the wellbore having an outer diameter larger than the restriction of the running tool to actuate, for example, a larger valve in the casing liner float collar or shoe below the running tool. Preferably, it would be desirable to be able to use balls at least in the range of 3½ or 4½ inches in outer diameter. However, it would be expensive to redesign the subsea/liner running tools to have a diameter through which such larger drop ball may pass and such redesign could reduce the tensile strength and hence the holding capability of the running tool.

The present invention allows existing systems for running casing liners to use balls having an outer diameter larger than the internal diameter of existing running tools or any other restriction in the running string. Therefore, the need to pay the high cost of redesigning the running tools is avoided while the advantages of using larger drop balls is achieved. The present invention also provides a larger diameter flow path for returns.

More particularly, the present invention provides a means for launching balls having a larger outer diameter than restrictions in the wellbore that can be used to perform useful functions in the wellbore below the restriction.

SUMMARY OF THE INVENTION

A drop ball system is provided for use in a wellbore having a restriction therein with a restriction internal diameter. The drop ball system allows launching a ball whose diameter is larger than the restriction such that the large ball may be utilized below the restriction in the wellbore. The drop ball system may be used with any tool requiring downhole ball activation or where downhole ball activation is desirable. Such applications include but are not limited to use with float equipment, flapper valves, squeeze tools, inflatable packers, running tools, adaptors, and test tools, for zone isolation, squeeze tools, squeeze production, and the like. In one embodiment, the drop ball system may comprise a drop ball housing that is mounted within the wellbore at a position in the wellbore below the restriction. A first ball or large ball is mounted in the drop ball housing which has an outer diameter larger than the restriction internal diameter.

A release element, such as a yieldable seat for the large ball, is provided for supporting the large ball prior to releasing the large ball from the drop ball housing into the wellbore. A second ball or release ball is provided having an outer diameter smaller than the restriction internal diameter. Upon receipt of the release ball in a seat in the housing, the large ball may be released through the release element by increasing the pressure above the release ball. In one preferred embodiment, the release element is a yieldable or breakable seat for the large ball. A moveable member, such as a sliding sleeve, may be mounted in the drop ball housing for engagement with the large ball to apply force to the large ball so as to release the large ball from the drop ball housing.

In one aspect of the invention, a tubing connector is provided on the drop ball housing for mounting the drop ball housing within the wellbore on a tubular element such as onto a string of wellbore tubulars or a continuous wellbore tubular such as coiled tubing. In another aspect of the invention, a wiper plug connector is provided on the drop ball housing so that the drop ball mechanism may be installed in a wiper plug. Thus, it is contemplated that the drop ball housing could be mounted on many different downhole members including members that may also be released into the wellbore. In one aspect of the invention, the drop ball housing consists of drillable material such that the drop ball housing can be drilled out with a wellbore drill bit.

A method is provided for a drop ball system for use in a wellbore having a wellbore restriction with a restriction inner diameter. The wellbore restriction could be one of many types and in many places such as found in tubular strings, running tools, adaptors, particular tools, and the like. The method includes the step of providing a drop ball housing within the wellbore at a position in said wellbore below the restriction. A first ball or large ball is provided in the drop ball housing having an outer diameter larger than the restriction inner diameter. The large ball is released from the drop ball housing. The drop ball housing may preferably be mounted to a downhole member. The downhole member could be a tubular string, coiled tubing, a wiper plug, or another downhole tool or member. A second ball or release ball is dropped into the wellbore to initiate the step of releasing the large ball. In one embodiment, the drop ball housing is responsive to fluid pressure acting thereon for releasing the large ball.

Thus, the present invention also provides a drop ball system that may be used in a tubular string for running a casing liner into a wellbore through another casing, such as but not limited to, a surface casing. The tubular string may have at least one restriction in internal diameter located therein. In this case, the restriction is typically in the running tool. A body for a drop ball sub may be provided with a flow path therein. A connector on the body may be used for connecting the drop ball sub to the tubular string at a position in the tubular string below the restriction. A first ball or large ball is mounted within the body. The large ball an outer diameter larger than the restriction internal diameter. A first seat or large ball seat may be provided within the body for the large ball. A second seat or release ball seat may be mounted in the body along the flow path. The release ball seat may be sized for receiving a release ball with an outer diameter smaller than the restriction internal diameter. A moveable sleeve may be connected to the release ball seat for movement in response to fluid pressure acting on the release ball when seated in the release ball seat. The moveable sleeve is preferably moveable from a first position to a second position to thereby cause the large ball to drop out of the body. In a preferred embodiment, the moveable sleeve acts to produce a force on the large ball when the sleeve is moved to the second position.

The system preferably also comprises a first diverter tool mounted in the tubular string on one side of the restriction such as above a running tool. A second diverter tool may be mounted on an opposite side of the restriction such as below the running tool.

Thus, a drop ball sub is described that may be used downhole in a tubular string. The drop ball sub is preferably used for launching the large ball from the drop ball sub in response to dropping the release ball into the drop ball sub through the tubular string. The large ball is larger in diameter than the release ball. The drop ball sub preferably comprises a body defining a passageway for fluid flow through the body. A large ball seat and a release ball seat are mounted in the body along the passageway. The large ball seat is sized to receive the large ball and the release ball seat is sized to receive the release ball. An actuating element may be responsive to receipt of the release ball into the release ball seat in the body for launching the large ball. The actuating element may preferably be a sleeve or slidable element secured to the release ball seat. The actuating element is moveable in response to pressure applied to the release ball seat when the release ball is dropped into the release ball seat. The actuating element may include engagement surfaces for engaging the large ball to thereby launch the large ball.

As a system for improved fluid flow while running a casing liner into a wellbore through a surface casing, the system then comprises a tubular string and a running tool mounted in the tubular string for running a casing liner into the wellbore through the surface casing. A first diverter tool may be mounted in the tubular string above the running tool. A second diverter tool may be mounted in the tubular string below the running tool. The first diverter tool has an open position to permit fluid flow out of the tubular string into the annulus between tubular string and the surface casing, while the second diverter tool has an open position to permit flow of the fluid in the annulus between a cement stinger and the casing liner being run into the tubular string through the running tool. The first diverter tool and the second diverter tool are responsive to a drop ball to move each of them to a closed position to shut off annular fluid flow. The system includes a drop ball sub that may be mounted to the tubular string or a stinger below the running tool. The drop ball sub comprises a large ball with an outer diameter larger than an inner diameter of the running tool. The system preferably includes a valve operable in response to receiving the large ball.

In operation, a method for using a drop ball sub within a tubular string used in a wellbore wherein the tubular string has a restriction with an internal diameter comprises positioning the drop ball sub within the tubular string at a position in the tubular string the restriction. A large ball is provided in the drop ball sub. The large ball has an outer diameter greater than the internal diameter of the restriction. A release ball, which has an outer diameter smaller than the restriction, may be dropped through the tubular string to activate the drop ball sub for dropping the first ball from the drop ball sub. A release ball seat for the release ball is provided in the drop ball sub. The release ball seat is responsive to pressure acting on the release ball seat for launching the large ball from the drop ball sub. A first diverter sub is provided in the tubular string at a position in the tubular string above the restriction. A second diverter sub is provided in the tubular string at a position in the tubular string below the restriction.

An object of the present invention is to permit launching a ball below a restriction in the wellbore even though the ball is larger in diameter than the restriction.

Another object of the present invention is to provide a drop ball sub that permits launching a large ball in response to dropping a smaller ball.

Another object of the present invention is to provide a drop ball sub that may be used with a wide variety of running tools, adaptors, wiper plugs, and the like.

Another object of the present invention is to provide a drillable drop ball sub for use where the drop ball sub may remain downhole and needs to be drilled out by the wellbore drilling bit.

An object of the present invention is to provide a system for increasing flow capacity while running casing and reduce the risk of plugging therein due to debris.

Another object of the present invention is to provide a system for dropping a ball larger than the internal diameter of a restriction in the running string such as the running tool.

Yet another object of the present invention is to provide an additional diverter in the running string so that flow goes into the running string, through the running tool, and back out from the running string into the annulus between the running and the previous string or strings of casing.

These and other objects, features, and advantages of the present invention will be made apparent to those of skill in the art in the following claims, description, and drawings. However, the present invention is not to be limited by any listed objects, features, or advantages that are listed simply as an aid those reviewing the specification to quickly discover some of the many benefits provided by the present invention.

A review of the following description in conjunction with the above listed technical drawings will permit one skilled in the art to further appreciate the many objects, features, and advantages of the present invention.

DESCRIPTION OF THE PREFERRED EMBODIMENTS

The drop ball sub or downhole ball release sub in accord with the present invention provides the capability to use a large ball having an outer diameter greater than the diameter of a restriction in the wellbore which may be of many types. For one example, the large ball is larger than the internal diameter of the running tool or drill string for running the casing liner. Reducing surge pressure and providing a larger flow path may be significantly enhanced with use of a large ball below the running tool, because downhole valves having large openings may be utilized. A running tool may be of several types and is typically an adaptor, e.g., an adaptor between drill pipe and casing. The drop ball sub is preferably activated by dropping a smaller ball with an outer diameter smaller than the outer diameter of the large ball. The size of the large ball may be, but is not limited to, a range from three and one quarter inches in outer diameter to four and three quarter inches in outer diameter.

Figure 1:
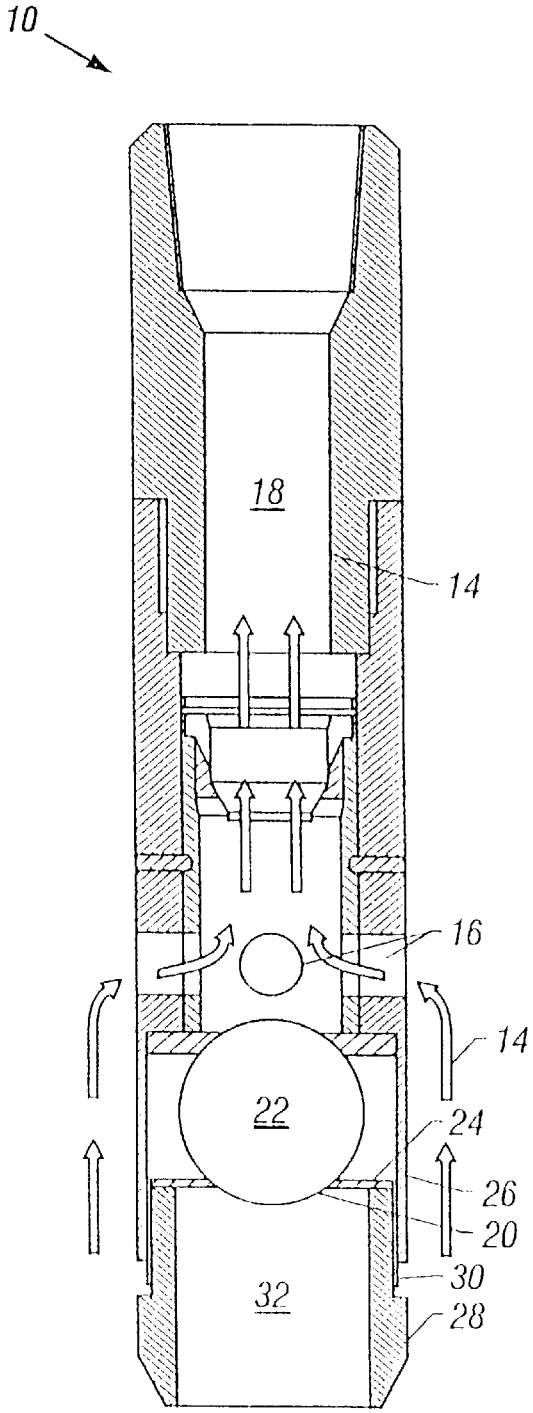
FIG. 1 is an elevational view, partially in section, of a drop ball sub in accord with the present invention in the running position.
Figures 6A, 6B, 6C:
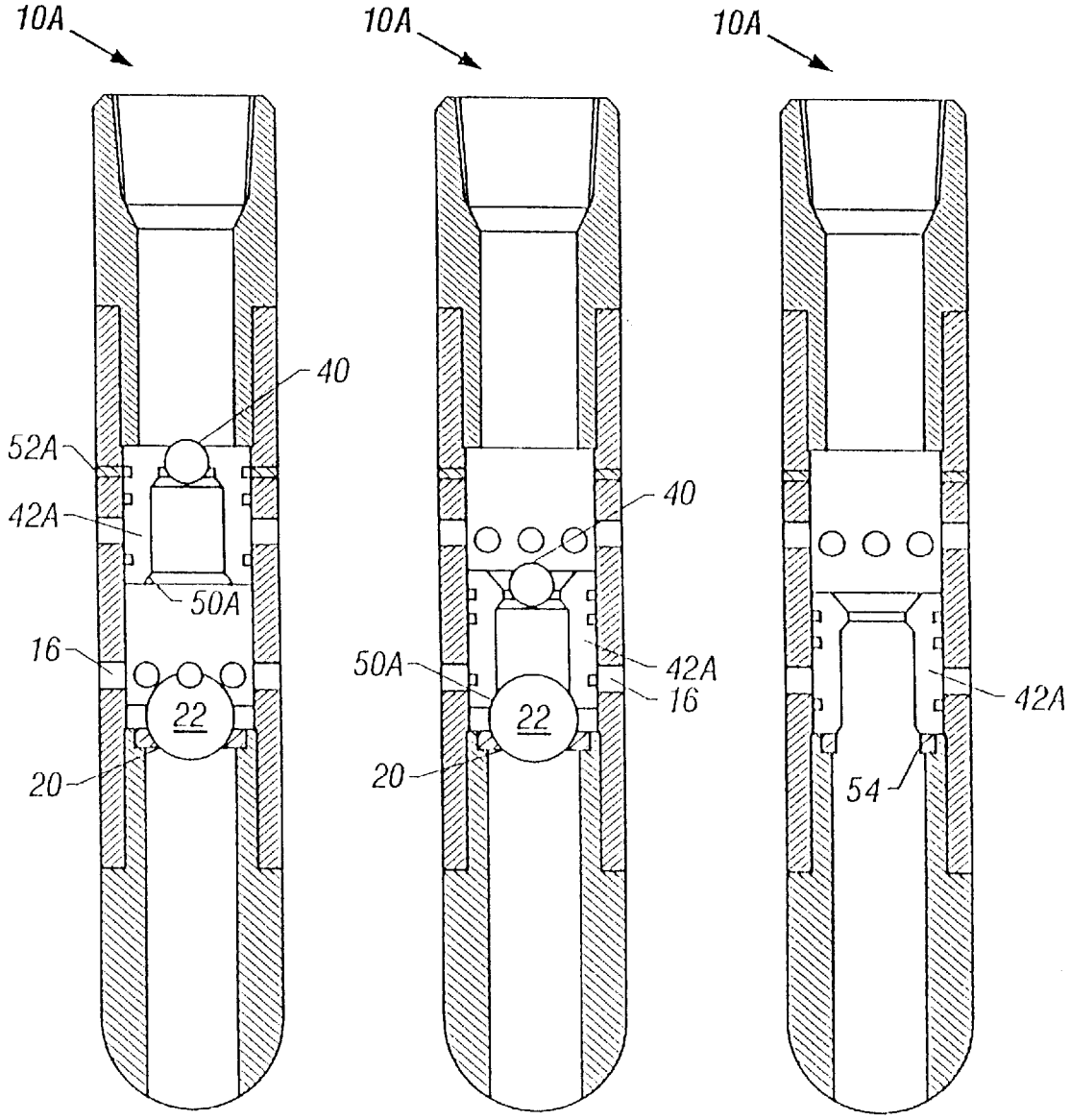
FIG. 6A is an elevational view, partially in section, of another drop ball sub in accord with the present invention prior to release of the large ball from the drop ball sub.
FIG. 6B is an elevational view, partially in section, of the drop ball sub of FIG. 6A with a shift sleeve engaging the large ball.
FIG. 6C is an elevational view, partially in section, of the drop ball sub of FIG. 6A after the large ball is dropped from the sub.
Figure 7:
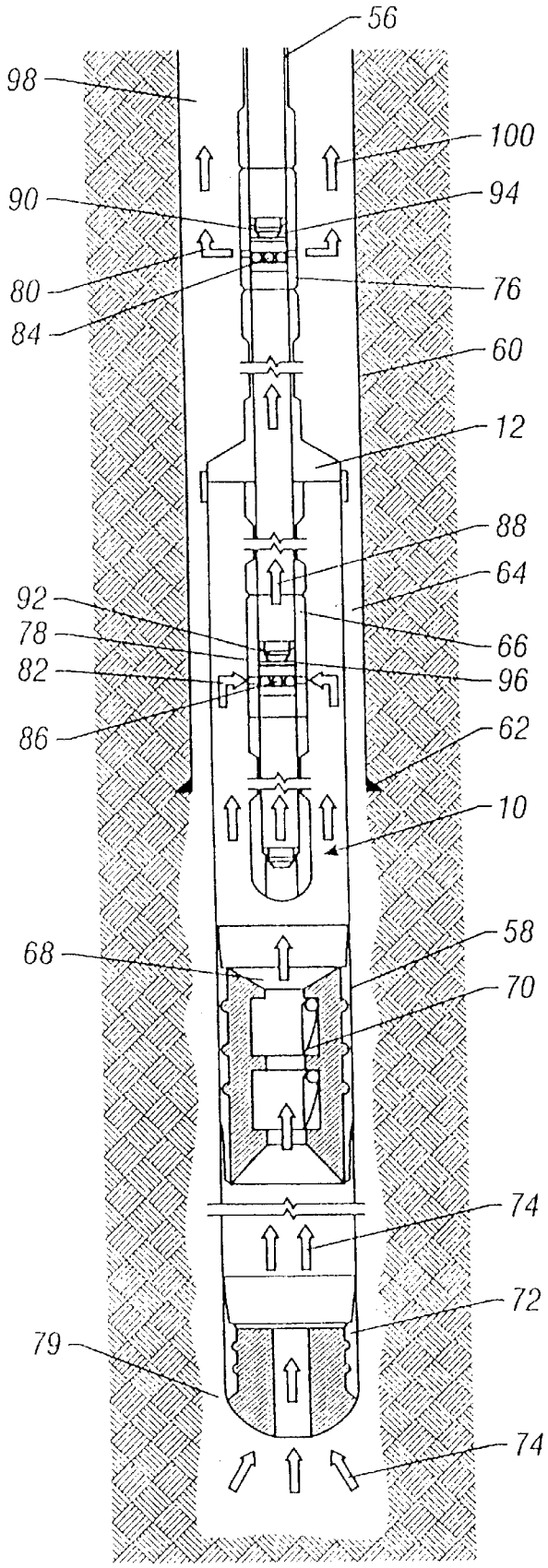
FIG. 7 is an elevational view, partially in section, showing a system using the drop ball sub and two diverter tools.
Figure 8:
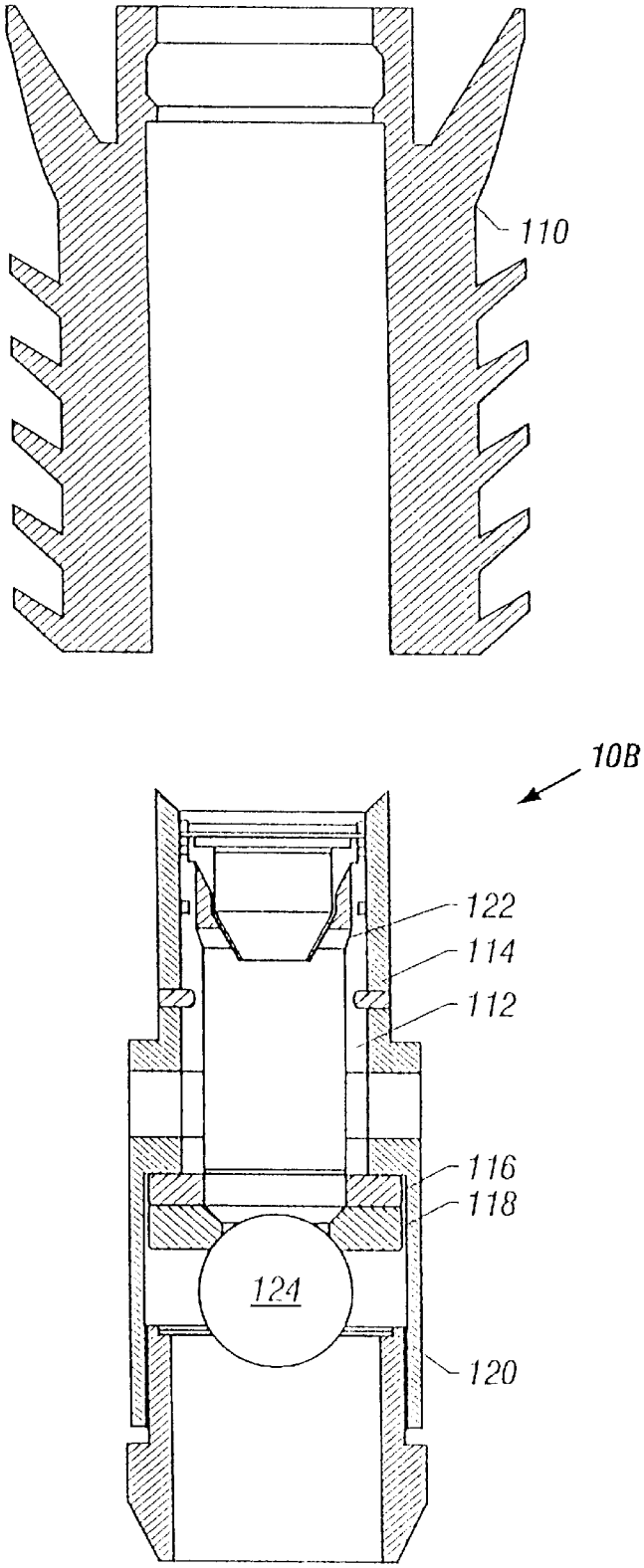
FIG. 8 is an elevational view, partially in section, showing a drillable drop ball sub for use in a downhole tool such as a wiper plug.

Referring now to the drawings, and more specifically to FIG. 1, there is shown a drop ball sub 10. Another embodiment 10A of drop ball sub is shown in FIG. 6A–FIG. 6C. Another embodiment 10B with a drillable drop ball sub body is shown in FIG. 8. In one embodiment, a preferred location of drop ball sub 10 for use in the casing running string is as shown in FIG. 7 below running tool 12 as discussed in more detail subsequently. Terminology such as "below", "above", and the like are used herein for convenience, especially with regard to easier understanding of the drawings. It will be understood that well depth may not be the same as actual depth, such as with horizontal wells or horizontal portions of wells. Also during shipping, packing, and assembly, items may not be above or below as they would be oriented in the casing running string. While balls are used in the preferred embodiment of the present invention, the term "ball" also includes any other suitable object, e.g. bars, darts, plugs, and the like. It will be understood that descriptions such as a restriction in the wellbore could refer to a restriction in any of the tubular strings, downhole tools, running tools, adaptors, valves, flapper valves or other downhole members.

Drop ball sub 10 is shown in the casing liner running position which is the initial position of operation. As the casing liner is run into the wellbore, fluid flow as indicated by flow lines 14, enters ports 16 and flows upwardly through bore 18 to thereby relieve surge pressure. Seat 20 supports large ball 22 and prevents large ball 22 from dropping out of drop ball sub 10 during running of the casing liner. Seat 20 preferably has a radius that mates to the particular outer diameter size of large ball 22. Seat 20 and seat support member 24 may be formed of various materials that are yieldable or breakable so as to operate in accord with the present invention. In one presently preferred embodiment, seat 20 and seat support member 24 may be formed of aluminum but it will be understood by one of skill in art that many materials including plastics, polymers, rubber, steel, other metals, combinations thereof, and the like could be used to provide a yieldable or breakable seat. Some materials for a yieldable, pliable, or breakable seat are discussed in the '881 patent referenced above. As well, seat 20 and seat support member 24 may be partitioned or otherwise designed so as to have yieldable, pliable, or breakaway portions. In this embodiment of the invention seat support member 24 is mounted onto mating notches 26 of end member 28. End member 28 is removable, such as with threads 30 or other means, to permit installation of large ball 22 and seat 20. End member 28 has a bore 32 sized to permit large ball 22 to pass therethrough.

Figure 2:
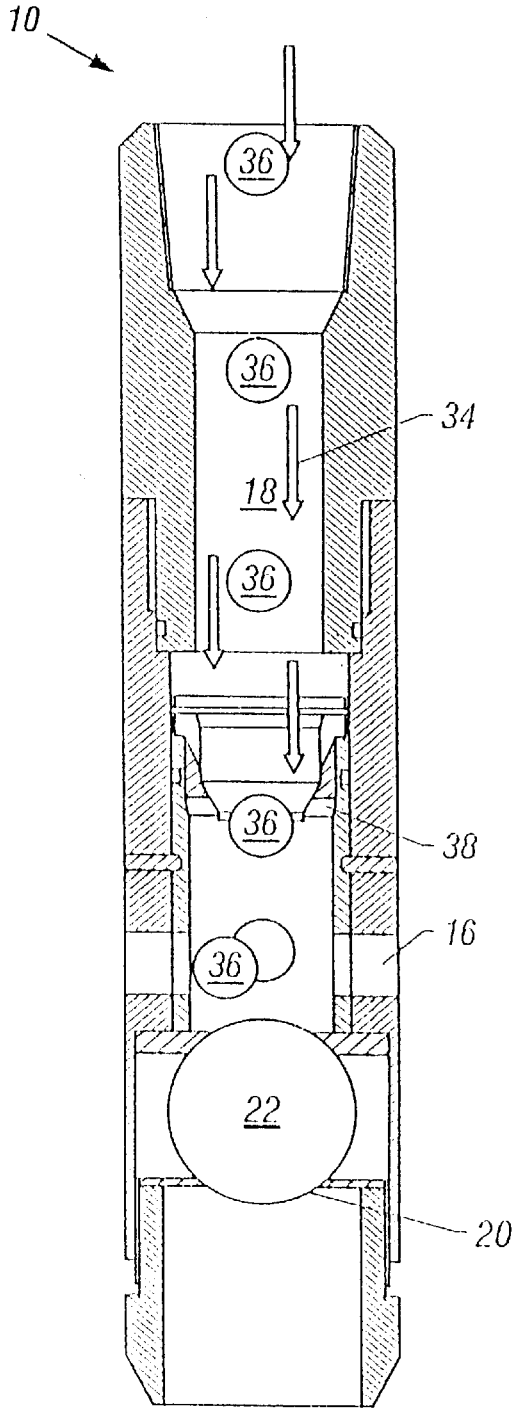
FIG. 2 is an elevational view, partially in section, of the drop ball sub of FIG. 1 after a clean out ball is dropped.

In FIG. 2, flow lines 34 indicate that flow through is going the opposite direction as compared with flow lines 14 shown in FIG. 1. Flow as per flow lines 34 may be used for circulation purposes such as, but not limited to, prior to cementing. During circulation, it may be desirable to drop wash ball 36 to aid in washing out debris such as debris that may be on big ball 22. Thus, wash ball 36 may fall through bore 18 of drop ball sub 10 as indicated in FIG. 2. Flow may proceed out of ports 16. Wash ball 36 is sized to be smaller than shift ball seat 38 so as to flow therethrough. Release ball seat 38 is discussed subsequently.

Figure 3:
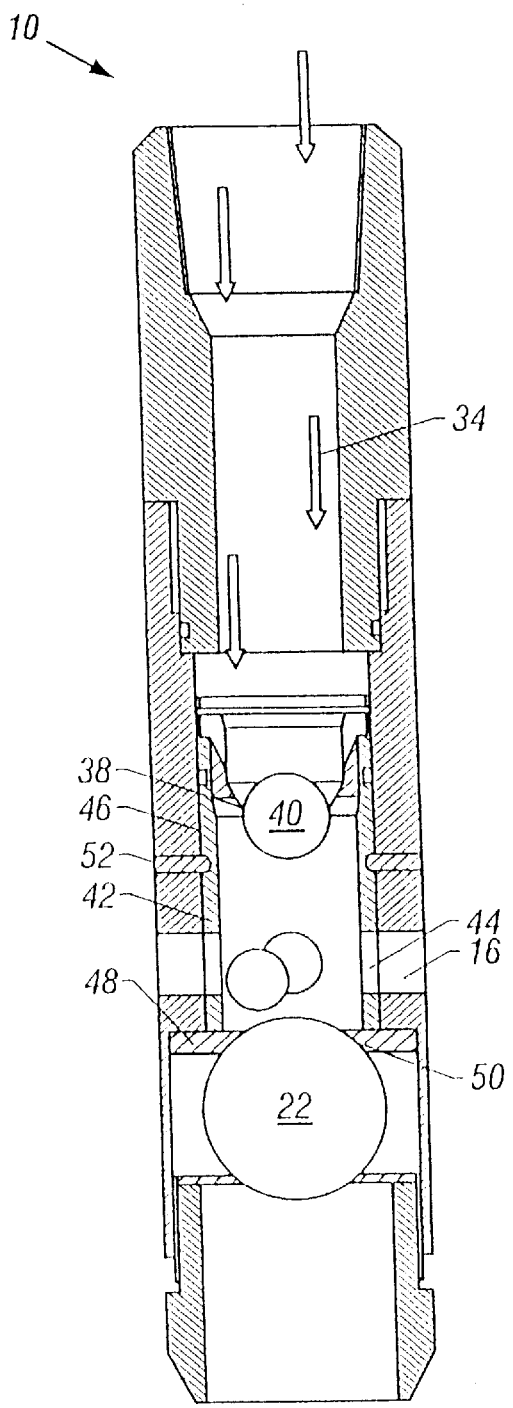
FIG. 3 is an elevational view, partially in section, of the drop ball sub of FIG. 1 after a release ball has been dropped and landed.

In FIG. 3, the sequence begins for launching large ball 22. Flow lines 34 indicate flow through drop ball sub 10 that is used to seat release or shift ball 40 in yieldable release ball seat 38. Once release ball 40 lands in release ball seat 38, fluid pressure builds up above release ball seat 38. This fluid pressure is used to dislodge large ball 22. In the presently preferred embodiment, release ball seat 38 is secured to sleeve 42. Sleeve 42 may preferably have shiftable holes 44 that line up with ports 16 to permit flow through ports 16 in both prior to landing release ball 40. Sleeve 42 may be shifted or slidable with respect to bore 46. In this embodiment, sleeve 42 compresses drive plate 48 to move large ball 22 out of drop ball sub 10. Drive plate 48 preferably includes a contour 50 sized to fit the outer diameter of large ball 22. In this embodiment of the invention, drive plate 48 may be made of a material such as steel. As discussed subsequently, drive plate 48 may also be made of drillable materials if desired. Sleeve 42 may be affixed into place prior to movement by some means such as shear pins 52 or other means, e.g. spring loaded fingers, as desired to hold sleeve 42 in position prior to operation thereof. Reference can also be made to the sliding sleeve in the diverter tool of the '881 patent designated above.

Figure 4:
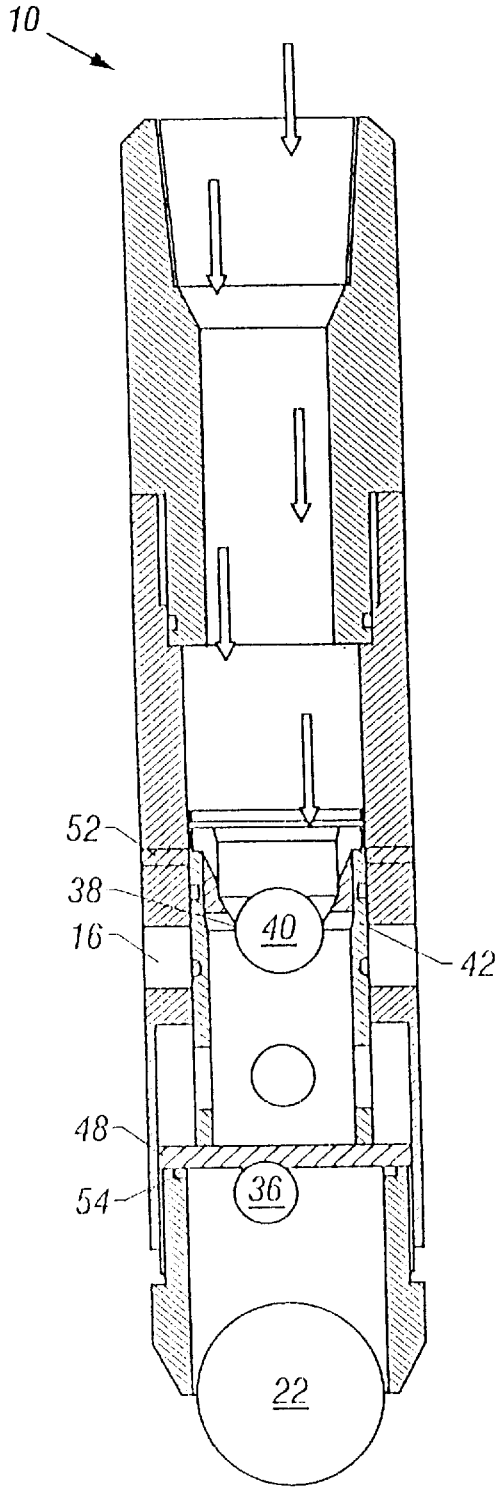
FIG. 4 is an elevational view, partially in section, of the drop ball sub of FIG. 1 showing a large ball exiting the drop ball sub.

FIG.4 shows large ball 22 departing or being launched from drop ball sub 10. Sleeve 42 has been moved downwardly by fluid pressure acting on ball 40 and seat 38 so that drive plate 48 has pushed large ball 22 through seat 20 on seat support member 24. Shear pins 52 were broken by the force acting on release ball 40 and seat 38. Drive plate 48 stops movement of sleeve 42 at shoulder 54. Ports 16 are sealed off by the movement of sleeve 42.

Figure 5:
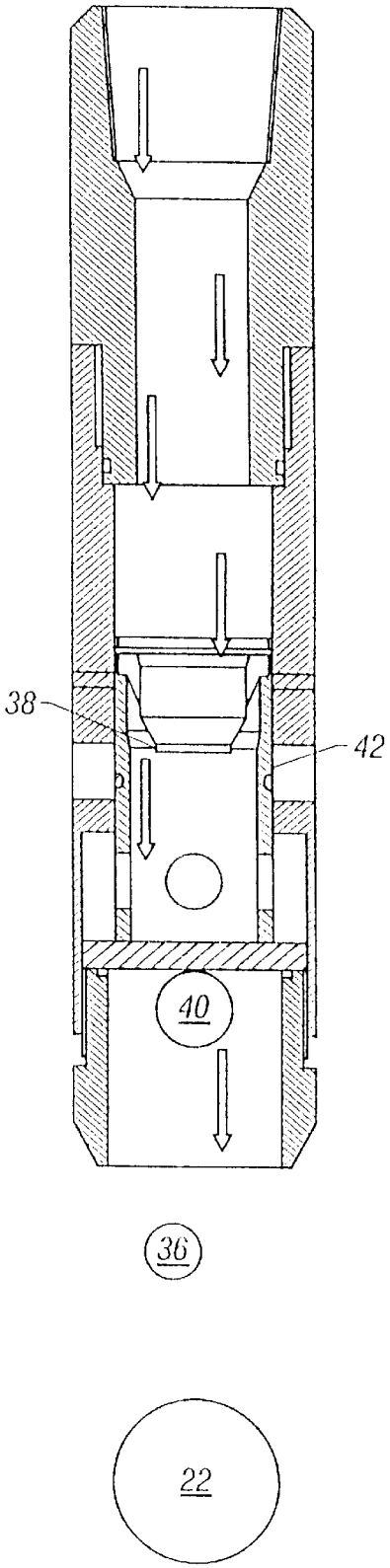
FIG. 5 is an elevational view, partially in section, of the drop ball sub of FIG. 1 showing the release ball exiting the drop ball sub.

FIG. 5 shows release ball 40 exiting from drop ball sub 10 after being forced through yieldable release ball seat 38. After drive plate 48 stops movement of sleeve 42 at shoulder 54, fluid pressure continues to build until release ball 40 is forced through yieldable release ball seat 38. The yieldable release ball seat 38 may be made according to one of several embodiments thereof described in the '881 patent which is designated above. Release ball seat 38 may have fracture lines or grooves that break as the pressure increases. As explained above, release ball seat 38 may be of various materials and combinations of materials including but not limited to plastic, rubber, or rubber coating, mild steel, or the like. As explained above, release ball 40 could also encompass other shapes and objects such as a dart, rod, plug, pig, or the like so as to operate to effect launching of large ball 22 from drop ball sub 10 as explained above. Large ball 22 may typically drop to a float collar or other downhole tool as discussed subsequently (see, FIG. 7).

FIG. 6A, FIG. 6B, and FIG. 6C show another similar embodiment of the drop ball sub referred to as drop ball sub 10A. Operation of drop ball 10A comprises the same principles as discussed above. FIG. 6A shows large ball 22 on seat 20. FIG. 6B shows the results of the release ball 40 being pressured up to move sleeve 42A downwardly to engage large ball 22. Sleeve 42A includes an engagement surface 50A that may preferably be shaped to mate to large ball 22. As indicated by FIG. 6C, sleeve 42A forces large ball 22 through seat 20 and is stopped by shoulder 54. After large ball 22 goes through seat 20, the release ball 40 then goes through its seat, as discussed above, and through seat 20. Ports 16 may be closed by movement of sleeve 42A. After operation of drop ball sub 10 or 10A, a cement operation may be used to cement the casing string in place within the well bore.

FIG. 7 shows drop ball sub 10 or 10A in position for operation. Running string 56 may be a drill pipe string. Although not limited to particular sizes, the system of FIG. 7 might show, for example only, a 5½ inch drill pipe string 56 for running 18 inch subsea casing such as casing 58. Casing 58 may be run through another string of casing 60 which may be surface casing or could be yet another string of casing. For example only, casing 60 might be 22 inch casing already cemented in place with shoe 62 being the bottom of casing 60. Running tool 12, which may be a subsea running tool, supports casing 58 and it will be understood that there is an annulus 64 between casing 58 and casing 60. A running tool is an adaptor, in this case to adapt from drill pipe string 56 to casing 58. The '881 patent referenced above explains how surge pressure can be reduced while running casing 58 through casing 60 even though annulus 64 between the two strings of casing may be relatively small. Stinger 66 below running tool 12 may be comprised mostly of drill pipe or other tubulars as desired.

Float collar 68 may include valves 70 that are operated by large ball 22. Float collars are known in the prior art; however, as noted below, the diameters of balls used to activate float collars have been limited to being smaller than the restriction in the wellbore, and the size of the bore in float collars has likewise been limited. A float collar 68 which can be activated using a ball whose diameter is larger than the restriction, has only recently been developed by one of the inventors in this application and others. Float collar 68 may preferably be set to function at various pressures such as, for example only, from about 300 up to about 3,000 p.s.i. Guide shoe 72 may preferably be located at the bottom of casing string 68. The use of large ball 22 allows for much larger diameter valves 70 to further reduce surge pressure and also allow debris to flow more easily.

As another aspect of the invention, it is preferable to have a first diverter tool 76 above running tool 12 and a second diverter tool 78 below running tool 12 attached to the bottom of stinger 66. An exemplary diverter tool in accord with the present invention is shown in the '881 patent referenced above. A diverter tool is used to provide a flow path into or out of the drill string as indicated by flow lines 80 and 82, when the diverter tool is in a first position. A ball, dart, or other means can be used to change the position of the diverter tool to the second position to block the flow path. More specifically, ports 84 and 86 on diverter tools 76 and 78, respectively, are open in the first position. This permits flow into or out of bore 88 of the running string 56. A control ball (not shown in FIG. 7) can be dropped into seat 90 of diverter tool 76. The pressure on the control ball then causes a sliding sleeve 94 to close ports 84. Once the ports 84 are closed, the control ball is blown through the seat 90 and lands in seat 92. Pressure on the control ball causes sliding sleeve 96 to close ports 86, and the control ball is blown through seat 92, once the ports 86 are closed. The control ball then lands in release ball seat 38 of drop ball sub 10. Pressure above the control ball launches large ball 22 from drop ball sub 10. Float collar 68 is then activated by large ball 22, and large ball 22 then drops to the bottom of the wellbore. Cementing of casing 58 may then be performed. Like release ball seat 38 on the ball drop tool discussed above, seats 90 and 92 are pliable or breakable so that the control ball can be blown through them to clear the bore for subsequent cementing. In one embodiment of the invention, the same control ball can be used to operate both first diverter tool 76 and second diverter tool 78 and to launch the large ball 22 from the drop ball sub 10. If for some reason it was desired to operate first diverter tool 76 and second diverter tool 78 independently, then the respective seats could be sized to accommodate differently sized control balls.

While running casing liner 58 into the wellbore, flow lines 74 show the flow of fluid through the casing string in accord with the present invention to thereby reduce the surge pressure. Casing string 58 will be cemented into open hole wellbore 79. Flow lines 74 proceed through lower diverter tool 78 and through drop ball sub 10 into stinger 66. The flow continues up bore 88 of the running string. Bore 88 provides a much better flow path than annulus 64 thereby reducing surge pressure. Once above stinger 12 in accord with the present invention, upper diverter tool 76 allows flow back into annulus 98 between running string 56 and casing 60. Thus, the flow path as indicated by arrows 100 is quite large and back pressure on flow through bore 88 is greatly reduced. Flow may also continue up bore 88 of running string 56 but may not reach the surface due to the larger flow path in annulus 98. In any event, the result of my invention is a higher volume flow path that even further reduces surge pressure and handles debris more easily. With the present invention, we are no longer limited to use of balls downhole which are smaller in diameter than the internal diameter of the subsea running tools.

To review, we take the returns through the large internal diameter float equipment such as float shoe 72 and float collar 68, up into the annulus between the drop ball sub 10 and casing liner 58 and through drop ball sub 10. Fluid flow continues into lower diverter 78, up cement stinger 66, through running tool 12, and then out top diverter sub 76 into the annulus 98 between casing 60 and the drill pipe or running string 56. Hence, we have surge reduction with bigger flow path. The flow through top or upper diverter sub 76 into annulus 98 forms a significant part of the bigger flow path. The use of two diverter tools is different from what has been done in the past for surge reduction. Using the upper diverter sub in combination with the drop ball sub and large ball is also a presently preferred embodiment of the invention. By using an additional upper diverter sub as shown at 76, flow path 100 includes the annulus 98 between the running string 56 and larger diameter casing 60. Lower diverter tool 78 directs flow into the drill pipe bore 88 and upper diverter tool 76 diverts it back to casing annulus 98.

Prior to the present invention, it has not been possible to use a 4½ inch outer diameter ball downhole because of the subsea running tool or other well restrictions. With the present invention, use of a 4½ inch ball downhole has been realized without having the need to redesign all the subsea running tools.

In FIG. 8, there is shown another embodiment 10B of the present invention for installation into a downhole member or tool such as for example, but not limited to, liner wiper plug or subsea casing plug 110. A non-exclusive list of other downhole tools or downhole members to which a drop ball sub, such as 10, 10A, or 10B, may be attached to and/or be used to activate include coiled tubing, tubing, float equipment, flapper valves, squeeze tools, test tools, any tools requiring downhole ball activation, and zone isolation tools.

For use with some downhole tools, such as cement wiper plugs that are designed to be drilled out, the embodiment of 10B includes a drillable drop ball sub body. By drillable, it is meant that a wellbore drill bit used for drilling out cement and continuing into the open hole can easily drill through the material from which drop ball sub body is made. Such materials have been discussed and include materials such as aluminum, plastics, rubber, urethane, and other relatively soft materials that are sturdy enough to perform the desired function but still easily drillable. Materials such as iron or steel would be avoided because the wellbore drill bit cannot easily drill through such materials. Instead, materials as iron and steel may typically prevent drilling completely, slow down drilling to a great degree, and/or damage the drill bit. Special mills rather than drill bits can be used to mill out only certain types of iron and steel structures but typically not loose iron or steel objects. Therefore, a drillable drop ball sub such as drop ball sub 10B would preferably not include iron or steel members. A presently preferred embodiment for a drillable drop ball sub would be comprised of aluminum. Therefore sleeve 112, drop ball sub body 114, drive plates 116 and 118, and large ball seat 120 may all be comprised of aluminum. Yieldable release ball seat 122 may be comprised of drillable materials discussed above with respect to release ball seat 38. Operation of drop ball sub 10B is the same as discussed above whereby large ball 124 is released by a release ball that causes sleeve 112 to move to push large ball 124 out of drop ball sub body 114. However, depending on the tool to which drop ball sub 10B is attached and/or the downhole tool which is activated by drop ball 124, some modifications to operational procedures might be desirable.

Figure 9:
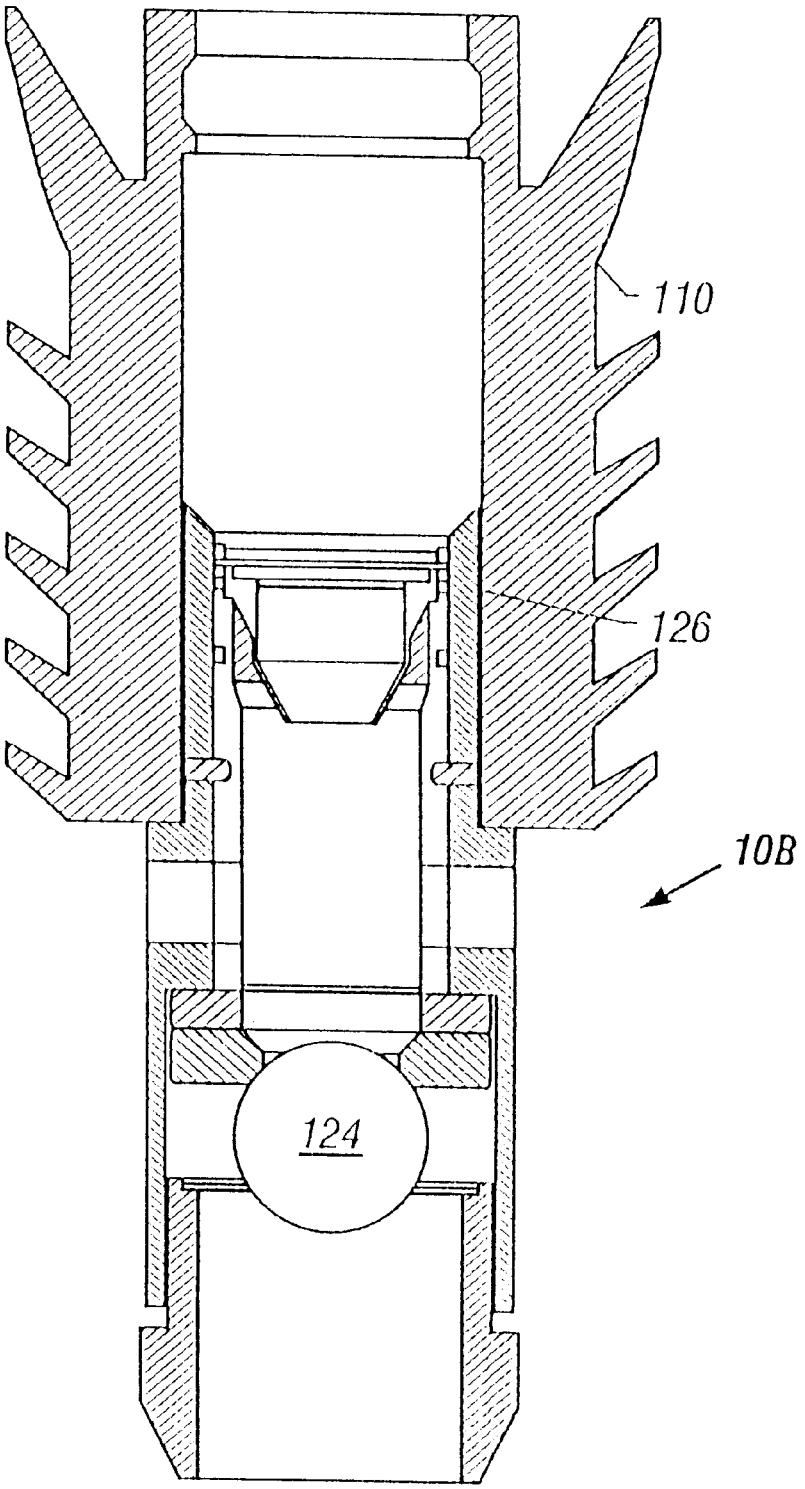
FIG. 9 is an elevational view, partially in section, of the drillable drop ball sub of FIG. 8 installed in a wiper plug.

FIG. 9 shows drop ball sub 10B installed within a cement wiper plug 110. Cement wiper plugs are widely used in various ways during cementing jobs. Drop ball sub 10B could be mounted to a top wiper plug or a bottom wiper plug or other wiper plug or wiper plug system as desired. Drop ball sub 10B may be attached to cement wiper plug 110 by various means such as threads, pins, fingers, pin and groove, and the like. In operation, the wiper plug may be fixed in the casing string within the wellbore by appropriate means known by those of skill in the art.

Figure 10:
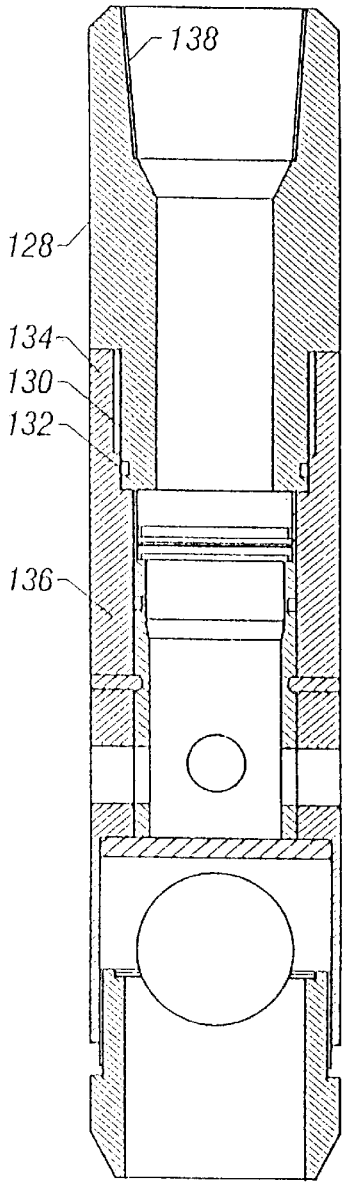
FIG. 10 is an elevation view, partially in section, of a drop ball sub for attachment to a variety of downhole tools.

FIG. 10 is used to illustrate that adaptor sub 128 may be of many forms for connecting to a wide variety of downhole members or tools. Adaptor sub 128 may connect by threads 130 and O-ring 132 to a mating connector 134 on drop ball sub body 136. Adaptor sub 128 may connect to wellbore tubulars such as tubing or coiled tubing as desired by means of connector 138 or other types of connectors as desired. In some cases, it is possible that drop ball sub body 136 may be adapted to mate to a particular downhole tool without an adaptor sub such as adaptor sub 128. However, it may normally be more convenient to design an adaptor sub that mates to a standard mating connector, such as connector 134, rather than redesign connector 134.

The invention may be used with large diameter casing such as 18 inch, 16 inch, 13⅝ and the like, to name a few sizes. The of the large balls, at this time, are preferably in the range of about 3½ and 4½ inches outer diameter although the present invention could be used with other sized balls. The large size of the balls itself is something that has never been used in the past due to limitations of the running tool or other wellbore restrictions. The float collar that has the ball seat to receive large ball 22 is already positioned in the casing. Any other type of tool to be operated by a large ball could also be used. As desired, the ball drop sub may preferably be positioned about 30–60 feet above the float collar so there is a void there. When large ball 22 is ejected from ball drop sub 10 or 10A, gravity brings it down into the float equipment such as float collar 68. Pressure is applied to activate the float equipment such as float collar 68. In the past, the largest ball that could be run was a 2.68 or 2¾ inch ball but with drop ball sub 10 or 10A, now we can run a 4.43 inch ball seat or 4½ inch ball so the ball seat area is substantially increased. Large ball 22 therefore allows us to handle more mud and more debris at lower pressures. Basically the result of the present invention is to increase the fluid handling capacity or size of the flow path.

The foregoing disclosure and description of the invention are illustrative and explanatory thereof, and various changes in the size, shape, methods of use, and materials, as well as in the details of the illustrated construction, may be made without departing from the spirit of the invention.

What is claimed is:

1. A drop ball system for use in a wellbore with downhole tool, the wellbore having restriction therein with a restriction internal diameter, the drop ball system comprising:

a drop ball housing which is mounted within the wellbore at a position in the wellbore below the restriction;

a first ball installed in the drop ball housing on a first seat, the diameter of the first ball being larger than the restriction internal diameter;

a release mechanism in the housing which, when activated, releases the first ball from the housing; and a second ball which is dropped from a location above the restriction, which passes through the restriction, which lands in the drop ball housing, and which is used in the activation of the release mechanism.

2. The system of claim 1, wherein the release mechanism comprises a second seat for receipt of the second ball and a sleeve which is moved downwardly when the pressure above the seated second ball is increased.

3. The system of claim 2, wherein the first seat is yieldable and wherein the downward movement of the sleeve pushes the first ball through the first seat to release the first ball from the drop ball housing.

4. The system of claim 1, further comprising a tubing connector associated with the drop ball housing for attaching the drop ball housing as part of a drill string within the wellbore.

5. The system of claim 1, further comprising a wiper plug connector on the drop ball housing for attaching the drop ball housing to a wiper plug.

6. A system for running a casing liner into a wellbore containing fluid, comprising:

a running tool having a restriction therein with a restriction internal diameter;

a drill string which is operable for lowering the casing liner into the wellbore using the running tool;

a body with a flow path therethrough;

a connector on the body for connecting the body to the drill string at a location below the restriction in the running tool;

a first ball installed within the body, the first ball having an outer diameter larger than the restriction internal diameter of the running tool;

a first seat within the body for the first ball;

a second seat mounted in the body in the flow path, the second seat being sized for receiving a second ball which passes through the restriction internal diameter of the running tool; and a moveable sleeve associated with the second seat for releasing the first ball from the body, the movement of the sleeve occurring in response to the second ball being received in the second seat and the pressure above the second ball being increased.

7. The system of claim 6, wherein the moveable sleeve is moveable from a first position to a second position to release the first ball out of the body.

8. The system of claim 7, further comprising:

a first diverter tool attached in the drill string above the running tool; and a second diverter tool attached in the drill string below the running tool and above the body.

9. In a method of running a casing liner into a wellbore containing fluid using a drill string and a running tool which has a bore therethrough with a first diameter and which is attached to the drill string, the improvement comprising:

releasing a first ball at a location in the wellbore below the running tool where the first ball has a diameter which is greater than the diameter of the bore in the running tool.

10. The method of claim 9, wherein the first ball is released by dropping a second ball from a location above the running tool where the second ball has a diameter which is less than the diameter of the bore in the running tool.

* * * * *